United States Patent [19]

Cane et al.

[11] Patent Number: 4,842,415

[45] Date of Patent: Jun. 27, 1989

[54] PAINT SHAKER

[75] Inventors: Michael R. Cane, Stockton; Michael H. Groves, Warwick, both of United Kingdom

[73] Assignee: Imperial Chemical Industries plc, London, England

[21] Appl. No.: 270,547

[22] Filed: Nov. 14, 1988

[30] Foreign Application Priority Data

Nov. 16, 1987 [GB] United Kingdom ..... 8726800
May 3, 1988 [GB] United Kingdom ..... 8810410
Sep. 5, 1988 [GB] United Kingdom ..... 8820823

[51] Int. Cl.[4] ..... B01F 11/00

[52] U.S. Cl. ..... 366/110; 366/128; 366/211; 366/237; 366/605

[58] Field of Search ..... 366/108, 110, 111, 127, 366/211, 237, 216, 208, 209, 128, 210, 605, 601, 217, 219; 248/154, 157, 507–509

[56] References Cited

U.S. PATENT DOCUMENTS 2,599,833 6/1952 Holmlund ..... 366/110 X
3,388,895 6/1968 Ogren et al. ..... 366/210
4,134,689 1/1979 Ahrenskou-Jorensen ..... 366/605 X
4,568,194 2/1986 Gargioni ..... 366/601 X
4,789,245 12/1988 Morbeck ..... 366/217

FOREIGN PATENT DOCUMENTS 1310655 3/1973 United Kingdom .
1586953 3/1981 United Kingdom .
2192138 1/1983 United Kingdom .

*Primary Examiner*—Timothy F. Simone
*Attorney, Agent, or Firm*—Cushman, Darby & Cushman

[57] ABSTRACT

A paint shaker (1) for use in in-store paint tinting operations comprising a platform (2) and clamping member (4) for accommodating a paint container (3) which is to be shaken wherein the shaker is provided with means for sensing resistance to downwards movement of the clamping member (4*a* or 34) and clamping member detection means (34) which do not allow the shaking operation to start until the container is clamped and the clamping member is in a pre-selected position chosen because it is a position that the clamping member must occupy if it is to clamp a container properly either directly or via a capsule from which colorant has been expelled.

16 Claims, 6 Drawing Sheets

PAINT SHAKER

This invention relates to a paint shaker suitable for encouraging the use of in-store tinting. "In-store paint tinting" is the practice of colouring a base paint in a retail shop or in a store or depot supplying professional painters by introducing a dose of colourant into the base paint and then shaking the paint to disperse the colourant. Base paints are usually white or some similarly easily tinted colour.

In-store paint tinting gives access to a much larger number of colours (often as many as 500) than could be economically kept in stock by a typical store. Efficient paint shakers such as those described in British patent specifications Nos. GB 1 310 655 and GB 1 586 953 (the contents of which are herein incorporated by reference) have been available for use in stores for many years and the practice of in-store paint tinting has been shown to work well. It is therefore a disappointment that the practice is not as widespread as might have been expected.

An objection on this invention is to identify the cause of the reluctance to use in-store tinting and then to provide means for overcoming it.

It has now been discovered that one reason why many people are discouraged from making use of in-store paint tinting is the reluctance of shops and stores to allow them to do their own tinting. Customers therefore have to rely on the services of a shop assistant or storeman who may not always be available. The reluctance to allow customers to do their own tinting has been found to arise from two problems. The first problem is that care is needed in selecting and introducing the correct dosage of colourant into the base paint. This problem could be largely overcome by providing metered amounts of colourant in specially compressible capsules from which colourant can be fully expelled by compressing the capsule. However care is still needed to ensure that the capsule is properly positioned before compression is allowed to start. The second problem is the care needed in operating the shaker safely. Unskilled operators (including even professional painters) have shown themselves to be quite capable of starting the shaking operation without having clamped the paint container in a safe position. This is so even when the shaker (for example the shaker described in GB No. 1 586 953) includes means for preventing the start of the shaking operation until a reaction to the clamping force has been detected.

Accordingly this invention provides a paint shaker which comprises (a) a shakeable platform on which a paint container can be positioned whereby paint in a container on a platform can be shaken by shaking the platform,
(b) agitating means for shaking the platform,
(c) actuating means for the agitating means,
(d) a clamping member moveable downwards to clamp a paint container in position on the platform,
(e) resistance sensing means which can sense a resistance to the downwards movement of the clamping member and which on sensing the resistance produces a transducible response,
(f) clamping member detection means which can detect when the clamping member is in a pre-selected position and which on detecting the member in that position produces a transducible response and (g) transducing means which transduces the responses to actuating means wherein the actuating means is operable only when in receipt of responses transduced both from the resistance sensing means and from the clamping member detection means whereby the agitating means can be actuated only if the clamping member is experiencing a reaction and is simultaneously in a pre-selected position.

A pre-selected position is a position which the clamping member occupies when it is clamping properly a paint container of a particular size. The position selected will be influenced by the size of the container and if it is intended to shake containers of several different sizes, the detection means must be capable of detecting the presence of the clamping member in one of several pre-selected positions.

The clamping member detection means may be mechanical, electrical or electro-mechanical. For example, a mechanical detection means may comprise a displaceable projection located at a pre-selected position and biassed to protrude into the downwards path of the clamping member so that when the clamping member arrives at the pre-selected position it displaces the projection producing a movement which can be transduced to govern the actuation of the agitator. If the clamping member leaves the position, the bias returns the projection with a reverse motion which is transduced to stop the agitator. An example of an electrical clamping member detection means comprises a pair of spaced electrodes located at a pre-selected position such that when an electrically conductive member arrives at the position, it bridges the electrodes and closes a circuit to produce a current which can be transduced to govern the actuation of the agitator. Departure of the clamping member from the position would re-open the circuit. Alternatively a circuit could be closed in response to the interruption of a beam of electromagnetic radiation (e.g. light or a radio wave) linked to a relay which operates a solenoid.

It is preferred to use a clamping member detection means which senses one or more edges (especially opposed edges) of the clamping member because this requires a more precise degree of detection and is better able to avoid false responses caused by for example slightly tilted containers.

The resistance sensing means may also be electromechanical. It may comprise a slightly tiltable plate as described in GB No. 1 586 953 which creates a transducible response by tilting when it meets the paint container and experiences resistance to its downward movement.

Alternatively the resistance sensing means may comprise a displaceable projection biassed to depend from the clamping member and positioned such that it contacts the paint container in advance of the clamping member whereby as the clamping member approaches the container, the projection is pushed back against the bias so creating a transducible response. An example of an electrical resistance sensing means comprises a pressure pad switch mounted on the under side of the clamping member so that it is sandwiched between the container and the clamping member during clamping.

Yet a further resistance sensing means comprises a fluid pressure system (preferably hydraulic) for moving the clamping member downwards and a pressure switch within the fluid pressure system. When the clamping member meets the container, the resistance to the further downwards movement can be sensed as an increase in pressure in the fluid pressure system which can operate the pressure switch thereby producing a transducible response.

The agitating means for shaking the platform is preferably powered by an electric motor in which case its actuating means may simply comprise a pair of switches located in series in the circuit which powers the motor.

One switch will be closed by a response transduced from the resistance sensing means and the other by a response transduced from the clamping member detection means. Clearly the motor will not be able to start until both switches have been closed which is to say until the resistance to downwards movement and the correct positioning of the clamping member have been sensed. The shaker preferably also comprises:

(a) a main frame suitable for standing on a supporting surface such as a floor or table,
(b) a suspension system by means of which the platform and the clamping means are mounted on the main frame, the suspension system comprising
  (i) an inner frame to which the shakeable platform is secured and which inner frame is moveable relative to the main frame,
  (ii) an intermediate frame on which the inner frame is mounted and which intermediate frame is both resiliently mounted on the main frame and moveable relative to the inner frame and
  (iii) at least one rigid link having a first part which is pivotally connected to an upper portion of the inner frame and a second part which is pivotally connected to the intermediate frame,
(c) a rotatable shaft mounted on the intermediate frame so as to allow rotation of the shaft about its central axis,
(d) at least one seating for a pivot, which seating is fixed to the shaft so as to rotate with the shaft and is spaced from the central axis of the shaft by a distance of from 10 to 50 mm,
(e) at least one pivot which is pivotally mounted in the seating and pivotally mounted in a lower portion of the inner frame whereby rotation of the shaft causes an eccentric movement of the pivot which imparts a shaking motion to the inner frame and hence to a paint container standing on the platform,
(f) fluid pressure means including a compressor for moving the clamping member and,
(g) a motor mounted on the intermediate frame below the platform and which can rotate the shaft. Such a shaker is capable of a shorter shaking cycle which also helps to encourage members of the public to use in-store paint tinting facilities provided in a retail shop.

The use in a shaker having a three-frame suspension of an eccentric pivot spaced 10 to 50 mm from the central axis of a driving shaft combined with a clamp operated by fluid pressure and a low mounted motor permits much quicker dispersion of colourant in a base paint and hence leads to a very quick shaking operation without creating major vibrations in the main frame of the shaker.

In practice, the shaker will usually be housed within a casing carried by the main frame and access to the platform will be via a hatch in the casing adjacent the platform. As the shaker is most likely to be operated by members of the public, it is preferred that the downwards movement of the clamping member be actuated by means responsive to the full closing of the hatch. In this way it becomes impossible for a customer to have his or her hands within the housing whilst clamping is taking place.

Preferably the clamping member comprises a plate pivotally mounted on the inner frame above the platform in such a way that when in a non-clamping position, the plate tilts to allow better access to the platform. Preferably the plate tilts to angle of 20° C. to 60° C. This better access has enabled the clamping plate to be nearer to the platform when in a non-clamping rest position which in turn means that the time taken for the plate to move down to a pre-selected position is reduced and hence the time taken to perform the tinting operation is less. The plate may tilt freely under gravity whereupon when the plate is drawn downwards onto the top of a paint container standing on the platform, the reaction from the container causes the plate to pivot into an essentially horizontal position. Alternatively the plate could be subjected to a positive tilting action which operates to tilt the plate into a horizontal plane as the plate moves downwards. For example the plate could be fitted with positive tilting means engageable with a co-operating means held stationery relative to the plate such as a cog on the plate which engages a stationary rack on the inner frame or a square section lug which engages a slot shaped to impart the necessary tilting action to the plate.

The shaker according to this invention is especially suitable for use when the dose of colourant is introduced from a compressible capsule positioned on the lid of a paint container and in communication with a hole provided in the lid. Such a use of a capsule is described in copending British patent applications GB No. 2 200 888 or GB No. 2 201 653 or corresponding United States patent application U.S. Ser. No. 061,423 (the contents of all of which are herein incorporated by reference). These applications describe a tinting system in which the paint container is clamped via the capsule whereupon it becomes possible to use the clamping force to compress the capsule and so expel positively the colourant from the capsule into the paint container. Subsequently the clamping force can also be used to enable a suitable capsule to close the hole in the lid. Clearly the shaking operation should not be allowed to start until this hole is properly closed and hence it is essential that shaking should not start until the clamping member has been detected as being in a position pre-selected because it is the position which must be occupied by the clamping member if it is to hold the capsule in a firm closing engagement with the hole. Detection of the clamping member in such a pre-selected position also serves to confirm that an unskilled operator has not forgotten to place a capsule on the lid, or even has not placed it on the lid upside down. By facilitating the use of compressible capsules containing metered amounts of colourant, the shaker also helps to overcome the other objections to allowing unskilled operators to do their own tinting, namely that they do not have the skill to meter the correct amounts of colourant or to ensure that the colourant is fully expelled from the capsule.

It has been discovered that when a dose of additive (for example colourant) is introduced from a capsule into paint in a paint container, the dispersion of additive in the paint can be improved if the paint in the container is first given a preliminary shake before introduction of the additive. Therefore it is an objective of a refinement of this invention to modify the paint shaker to enable it to give the paint a preliminary shake.

Accordingly a refinement of this invention provides a modified paint shaker suitable for imparting a preliminary shake to paint in a container about to receive additive from a compressible capsule in place on the container characterised in that the shaker additionally comprises (f) retractable gripping means for gripping the container, (g) holding means for holding the capsule against the container without compressing it sufficiently to expel additive and (h) means for actuating the agitating means when the container is gripped and the capsule is held.

It is possible to use the clamping member as the holding means for the capsule if the shaker is provided with means for interrupting the downwards travel of the clamping member at a point at which the clamping member abuts the capsule without compressing it to expel additive. Suitable means comprises a retractable stop moveable into and out of the path of the clamping member. Most conveniently, an upper surface of the retractable gripping means may serve as the stop.

The invention is further illustrated by the following preferred embodiments described with reference to the drawings. For clarity, the general construction of a shaker will be described first with reference to FIGS. 1 and 2 and then the provision of a resistance sensing means, a clamping member detection means and a positive clamping member tilting device in the general structure will be described. In the drawings FIG. 1 is a side elevation of a paint shaker with the casing shown in section and part of the hydraulic system omitted for clarity, FIG. 2 is a front elevation of the shaker shown in FIG. 1 again with the casing shown in section but his time with shock-absorbers omitted for clarify, FIG. 3 is a front elevation of part of the shaker as shown in FIG. 2 which also shows a resistance sensing means, a clamping member detection means and part of a circuit for actuating the compressor in accordance with this invention, FIGS. 4 and 5 are details on a larger scale taken from FIG. 3, FIG. 6 is a detail taken from FIG. 3 which shows a rib modified to provide positive tilting of the clamping plate, FIG. 7 is a front elevation (with part in section) of a clamping plate and a container with a capsule resting on its lid.

Figure 1:
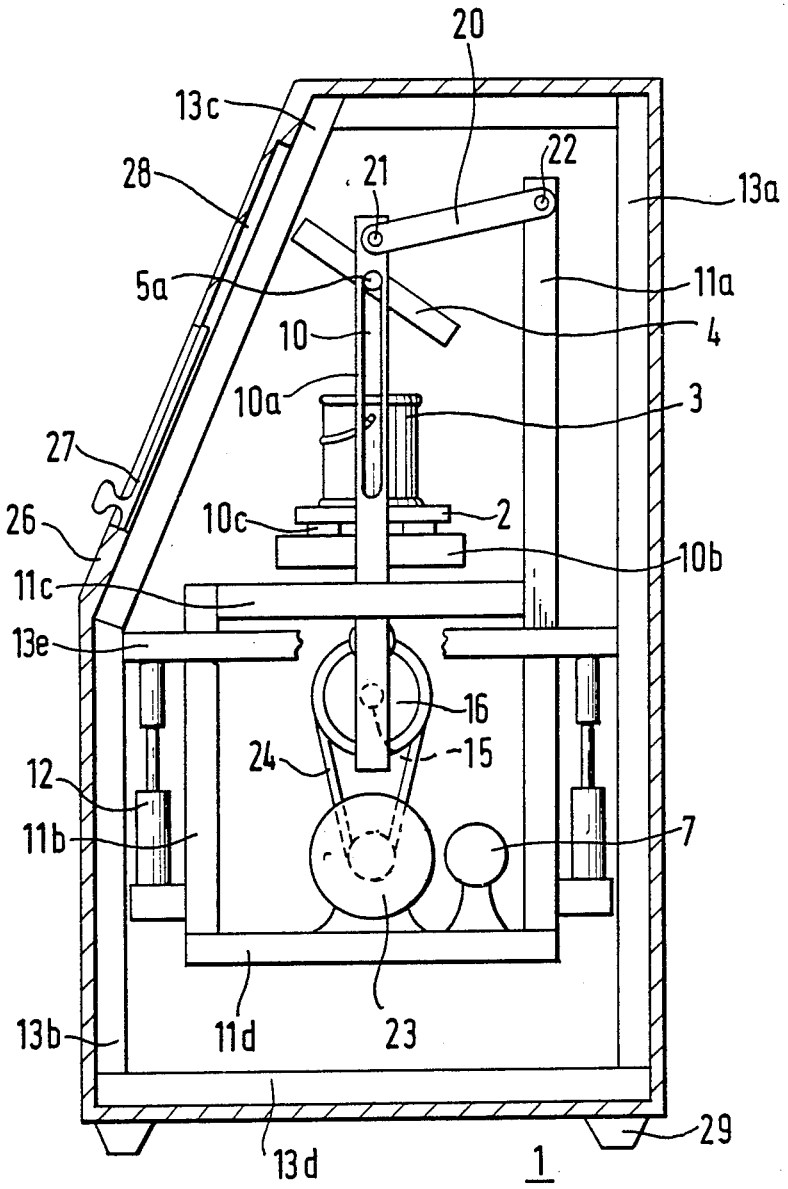
Figure 2:
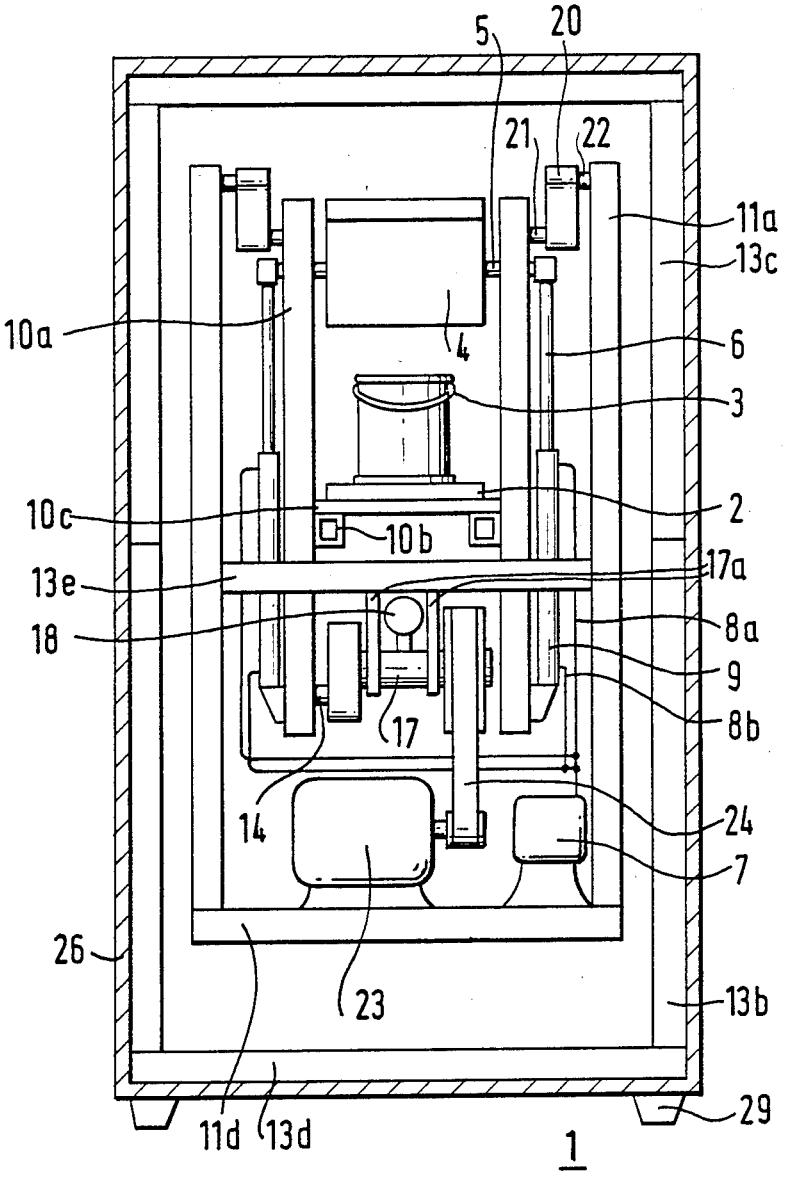

FIG. 1 shows a paint shaker 1 having a shakeable platform 2 on which stands a paint container 3. Shaker 1 has a clamping plate 4 tilted at 35° to 50° from horizontal about axle 5 (shown in FIG. 2) and supported by hydraulic piston-rods 6 (also shown in FIG. 2). To clamp paint container 3, hydraulic pressure is generated by compressor 7 and transmitted to cylinder 9 via line 8*a*. (For clarity items 6, 8*a*, 8*b*, and 9 have been omitted from FIG. 1). The pressure acts on a piston (not shown) in cylinder 9 so as to draw down piston rod 6 and move plate 4 downwards onto the top of paint container 3. The descent of plate 4 is guided by ends 5*a* of axle 5 which engage slots 10 in upright rib 10a. As clamping plate 4 meets container 3, initial resistance to downwards movement posed by container 3 tilts plate 4 into a horizontal plane whereafter it clamps container 3 onto platform 2. Clamping takes only 2 seconds from the start of the descent of plate 4 to its arrival in the fully clamped position. Unclamping is performed by releasing the pressure in line 8*a* and generating pressure which is transmitted along line 8*b* into cylinder 9 to raise piston rod 6 so reversing the movements of clamping plate 4 described above. Unclamping takes only 2 seconds.

Platform 2 and clamping plate 4 are mounted on an inner frame composed of upright ribs 10*a* and cross ribs 10*b* and 10*c*. This inner frame nests within an intermediate frame composed of upright ribs 11*a* and 11*b* and ross ribs 11*c* and 11*d*. This intermediate frame is mounted by means of resilient shock-absorbers 12 (omitted from FIG. 2) on a main frame which is composed of upright ribs 13*a*, 13*b* and 13*c* and cross ribs 13*d* and 13*e*. The inner frame is supported on pivot 14 which forms part of the agitating means for shaker 1.

In addition to pivot 14, the agitating means also includes wheel 16, drive shaft 17, counter weight 18, electric motor 23 and belt drive 24. Pivot 14 engages both the lower end of rib 10*a* and a cylindrical seating 15 located eccentrically in wheel 16 which is fixed to rotatable drive shaft 17 mounted in brackets 17*a* suspended from cross rib 11*c* of the intermediate frame. The central axis of cylindrical seating 15 is spaced 20 mm radially outwardly of the central axis of shaft 17. Rotation of drive shaft 17 causes rotation of wheel 16 which in turn imparts a shaking motion to the inner frame and hence to platform 2 and paint container 3. Shaft 17 also carries a counter weight 18 to offset the asymmetric loading imposed by pivot 14. The movement of the upper ends of ribs 10*a* of the inner frame is constrained by rigid links 20 which are pivotally connected to both ribs 10*a* and 11*a* by pins 21 and 22 respectively. This linking together and the selection of the correct spacing of seating 15 from shaft 17 are important to ensure an efficient transfer of energy to the contents of paint container 1 which in turn leads to a quicker shaking cycle. Drive shaft 17 is rotated by electric motor 23 mounted well below platform 2 and coupled to shaft 17 via belt drive 24. The circuit which contains motor 23 contains two switches 32 and 36 both of which must be closed to actuate motor 23.

Shaker 1 is housed within casing 26 which is supported on ribs 13*a*, 13*b*, 13*c*, 13*d*, and 13*e* of the main frame. Access to platform 2 is via a hatch 27 which slides into recess 28 on runners (not shown) attached to casing 26. A trip switch 25 (shown in FIG. 3) can be provided which is thrown by hatch (27) reaching the closed position whereupon the trip switch closes a circuit which actuates compressor 7 and causes the downwards movement of clamping plate 4 into a pre-selected position where it clamps container 3.

Figure 4:
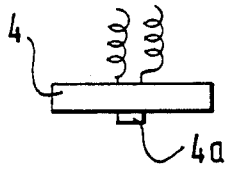
Figure 3:
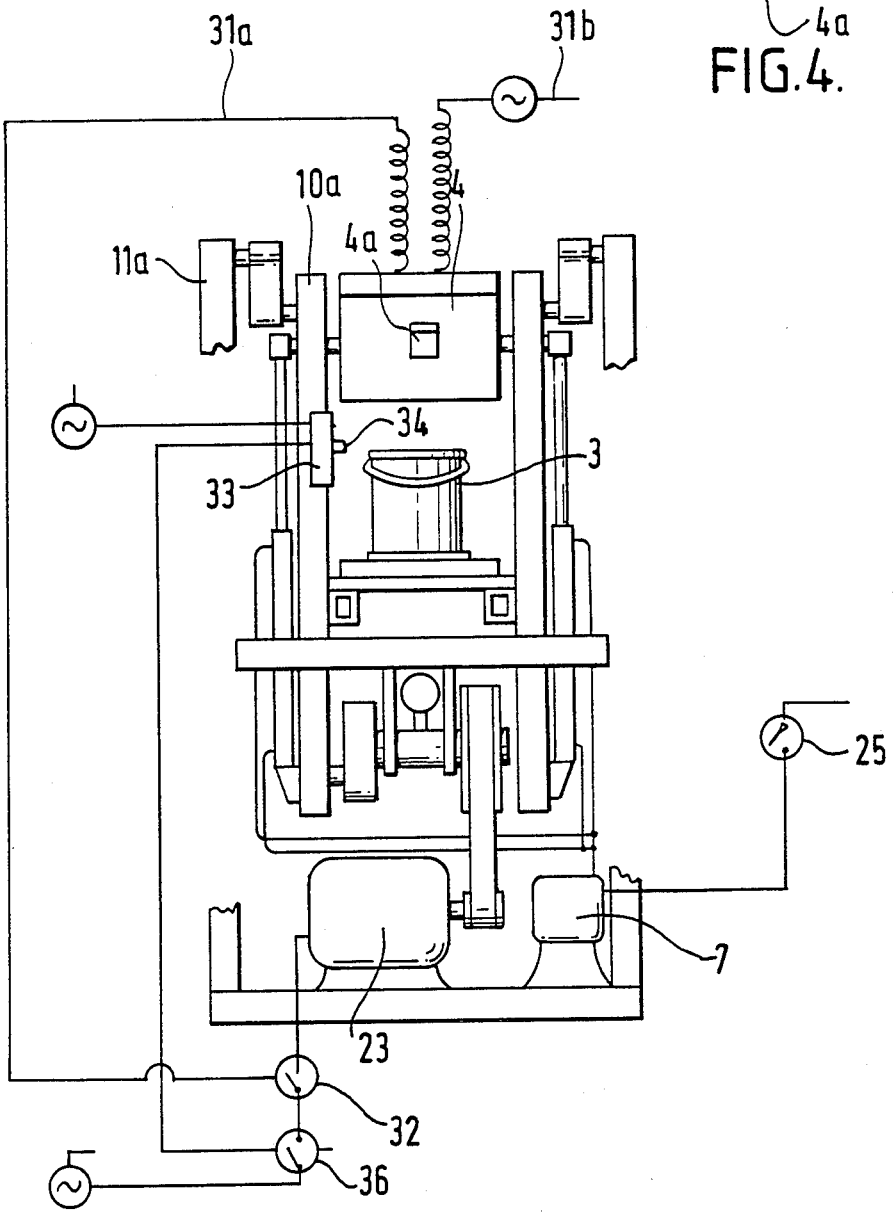

FIG. 3 illustrates diagrammatically the use of a resistance sensor and a clamping member detector to ensure that motor 23 can only be started if paint container 3 is being clamped by clamping plate 4 when plate 4 is in a pre-selected position. For simplicity, most of the neutral return in each circuit shown in FIG. 3 has been omitted. FIGS. 3 and 4 show the push button 4*a* of a pressure switch (not shown but similar in principle to switch 33) inserted into clamping plate 4. As plate 4 moves downwards onto container 3 located in a predetermined position, button 4*a* meets and senses an initial resistance to downwards movement and is pushed upwards until plate 4 clamps container 3. The upwards movement of button 4*a* closes the touch sensing switch allowing a current to flow in wires 31*a* and 31*b* which is then used to close a switch 32 in the energising circuit for motor 23. Hence the response produced as a result of button 4*a* sensing a resistance to downwards movement is transduced to switch 32.

Figure 5:
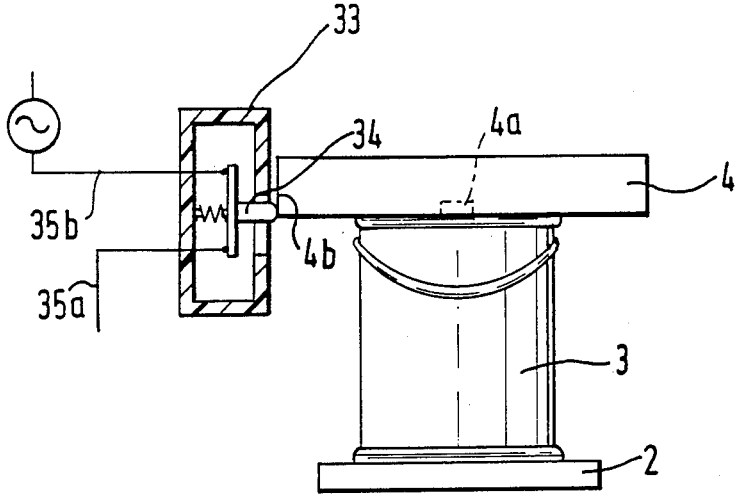

A second touch sensing switch 33 is attached to rib 10*a* of shaker 1 and is provided with a spring biassed push button 34 more easily seen in FIG. 5. Button 34 protrudes into the downwards path of clamping plate 4 at a position pre-selected to correspond to the position plate 4 must occupy if it is to clamp container 3 properly. When (as shown in FIG. 5) plate 4 is clamping container 3, the edge 4*b* of plate 4 displaces push button 34 back against its bias and into contact with the terminals of wires 35*a* and 35*b* allowing a current to flow which is then used to close switch 36 in the energising circuit for motor 23. Hence the response produced as a result of push button 34 sensing the arrival of plate 4 into a pre-selected position is transduced to switch 36.

Clearly to actuate motor 23; it is necessary for transduced responses to close both switches 32 and 36 and so agitation can be started only when a resistance to downwards movement of the clamping plate 4 has been detected and when the clamping plate 4 has been detected in a pre-selected position.

Figure 6:
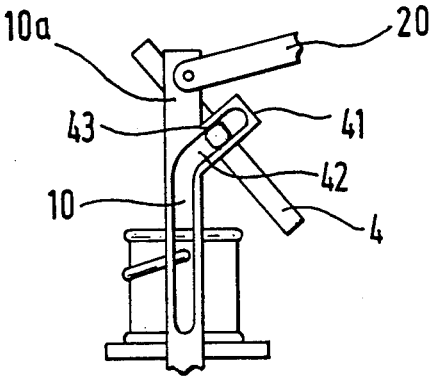

FIG. 6 illustrates positive means of tilting a clamping member.

FIG. 6 shows an inner frame rib 10*a* provided with a spur 41 into which slot 10 turns and terminates in a spur slot 42. Clamping plate 4 is engaged in slots 42 and 10 by means of a lug 43 which makes a sliding fit. Lug 43 is essentially square in cross-section but with rounded corners so that when plate 4 moves downwards, lug 43 is rotated as it passes round the curve which connects spur slot 42 with slot 10. Rotation of lug 43 causes plate 4 to rotate from an inclined to a horizontal position.

FIGS. 7 to 10 illustrate a possible modification for the shaker shown in FIG. 3. The modification enables the shaker to impart a preliminary shake to paint 65 in container 3.

Figure 7:
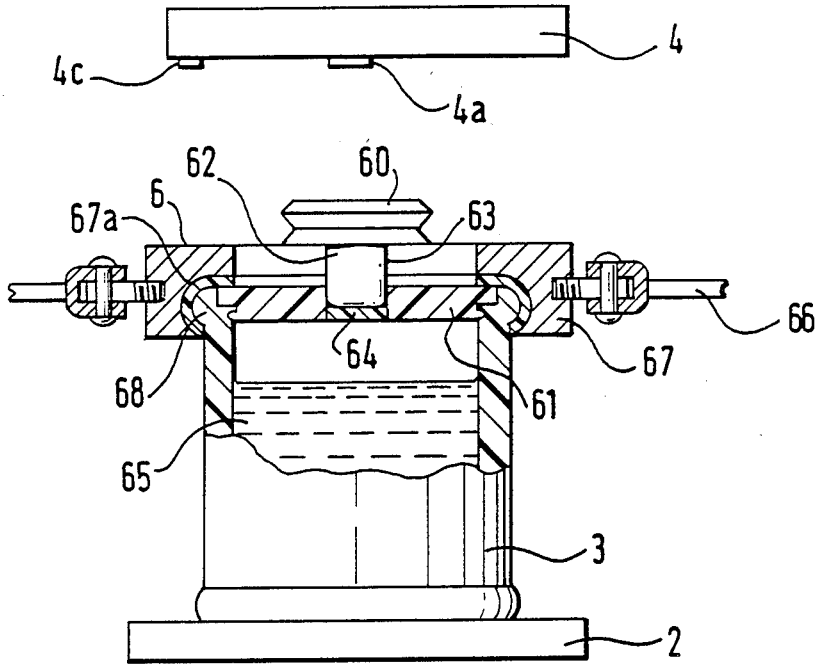
Figure 8:
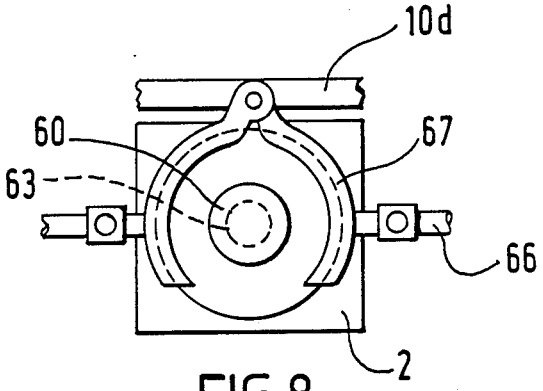
FIG. 8 is a plan view from above on the plan A—A shown in FIG. 7.

FIG. 7 shows a compressible cylindrical capsule 60 containing additive (not shown) in position on the lid 61 of container 3 which in turn stands on platform 2 of the shaker shown in FIG. 3. Container 3 also stands beneath a modified clamping plate 4. Plate 4 is modified so as to have a second touch sensing switch 4*c* which when closed encogises motor 23 and actuates a preliminary period of shaking. Capsule 60 has a dependent spout 62 which makes a close fit in entry port 63 in lid 61 and abuts plug 64 which makes a sealing push fit in port 63.

Figure 9:
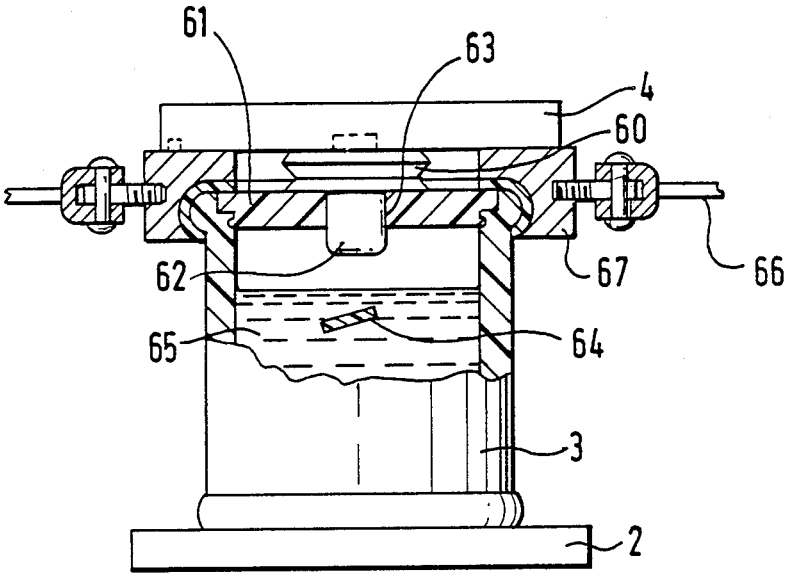
FIG. 9 is the front elevation of FIG. 7 but with the clamping plate touching the capsule.

In use, container 3 with capsule 60 is placed on platform 2 with spout 62 abutting plug 64 then hatch 27 is closed. Hatch 27 is provided with a second trip switch (not shown) which actuates a motor (not shown) which causes link 66 to close metal callipers 67 so that they move from the position shown in FIG. 10 to that shown in FIG. 8 where they grip upper portion 68 of container 3. Callipers 67 may be conveniently mounted on a rib 10*c* which in turn is carried by upright ribs 10*a*. Callipers 67 are also provided with resilient rubber bushes 67*a* to assist in gripping. Closure of hatch 27 also causes plate 4 to descend whereupon it pushes capsule 60 and its spout 62 downwards but with insufficient force to compress capsule 60 to cause expulsion of additive. Downwards movement of spout 62 forces plug 64 out of port 63 as shown in FIG. 9. Plate 4 then encounters upper surface 69 of callipers 66 which serves as a stop and prevents further descent of plate 4 and in particular prevents compression of capsule 60 at least to an extent which would cause expulsion of additive. Plate 4 then holds capsule 60 against lid 61 and depression of touch sensing switch 4*c* actuates preliminary shaking for a pre-determined period of time.

Figure 10:
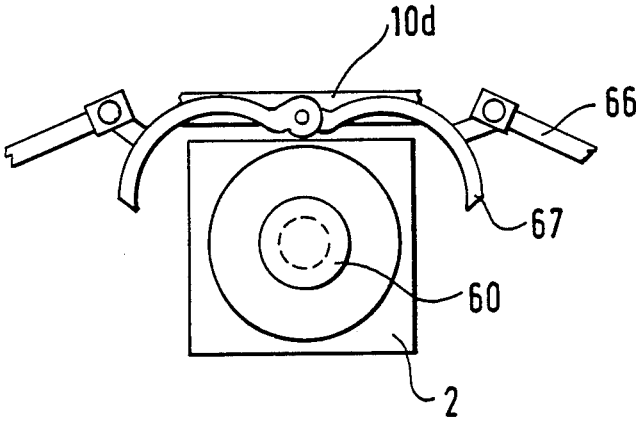
FIG. 10 is the plan view of FIG. 8 but showing the callipers open.

When preliminary shaking has been completed, means not shown signals the retraction of callipers 66 to the position shown in FIG. 10 whereupon clamping plate 4 is free to continue its descent and enter the procedure described with reference to FIG. 3. It should be explained that spout 62 is provided with means (such as a push fit plug) which enable it to be opened in response to a compression of capsule 60 so as to allow expulsion of additive from capsule 60.

We claim:

1. A paint shaker (1) which comprises (a) a shakeable platform (2) on which a paint container (3) can be positioned whereby paint (65) in a container on the platform can be shaken by shaking the platform, (b) agitating means (14 to 18, 23 and 24) for shaking the platform.

(c) actuating means (32 and 36) for the agitating means, (d) a clamping member (4) moveable downwards to clamp a paint container in position on the platform, (e) clamping sensing means which can detect clamping by sensing a reaction to the clamping force and which on sensing the reaction produces a transducible response, (f) clamping member detection means (34) which can detect when the clamping member is in a pre-selected position and which on detecting the member in that position produces a transducible response and (g) transducing means (30, 31*a*, 31*b*, 36*a* and 36*b*) which transduces the responses to the actuating means wherein the actuating means is operable only when in receipt of responses transduced both from the clamping sensing means and from the clamp member detection means whereby the agitating means can be actuated only if a paint container is being clamped by the clamping member when in a pre-selected position.

2. A shaker according to claim 1 wherein the clamping member detection means detects at least one edge (4*b*) of the clamping member.

3. A shaker according to claim 1 wherein the resistance sensing means and the clamping member detection means each comprise a touch sensing switch (33) provided with a push button (4*a*, 34).

4. A shaker according to claim 1 wherein the agitating means includes an electric motor (23) and the actuating means for the motor comprises two switches (32 and 36) in series in a circuit which powers the motor.

5. A shaker according to claim 1 provided with more than one clamping member detection means whereby the clamping member can be detected in more than one pre-selected position so that the shaker can be used with paint containers of different sizes.

6. A shaker according to claim 1 which also comprises (a) a main frame (13*a*, 13*b*, 13*c* and 13*d*) suitable for standing on a supporting surface such as a floor or table, (b) a suspension system by means of which the platform and the clamping means are mounted on the main frame, the suspension system comprising
  (i) an inner frame (10*a*, 10*b*, 10*c* and 10*d*) to which the shakeable platform is secured and which inner frame is moveable relative to the main frame,
  (ii) an intermediate frame (11*a*, 11*b*, 11*c* and 11*d*) on which the inner frame is mounted and which intermediate frame is both resiliently mounted on the main frame and moveable relative to the inner frame and
  (iii) at least one rigid link (20) having a first part which is pivotally connected to an upper portion of the inner frame (11*a*) and a second part which is pivotally connected to the intermediate frame,
(c) a rotatable shaft (17) mounted on the intermediate frame so as to allow rotation of the shaft about its central axis,
(d) at least one seating (15) for a pivot (14), which seating is fixed to the shaft so as to rotate with the shaft and is spaced from the central axis of the shaft by a distance of from 10 to 50 mm,
(e) at least one pivot (14) which is pivotally mounted in the seating and pivotally mounted in a lower portion of the inner frame (10*a*) whereby rotation of the shaft causes an eccentric movement of the pivot which imparts a shaking motion to the inner frame and hence to a paint container standing on the platform,
(f) fluid pressure means (6 and 9) including a compressor (7) for moving the clamping member and
(g) a motor (23) mounted on the intermediate frame below the platform and which can rotate the shaft.

7. A shaker according to claim 1 wherein the clamping member is a tiltable plate (4).

8. A shaker according to claim 7 which comprises tilting means (10, 41 and 43) which positively tilt the plate into a horizontal plane in response to a downwards movement of the plate.

9. A shaker according to claim 1 when located within a housing (26) which has a hatch (27) to give access to the shakeable platform wherein the clamping member only becomes moveable downwards when the hatch is closed.

10. A shaker according to claim 1 wherein at least one of the pre-selected positions is selected because it is a position which the clamping member must occupy when it is clamping a paint container via a capsule (60) located on the paint container.

11. A shaker according to claim 1 suitable for imparting a preliminary shake to paint in a container (3) about to receive additive from a compressible capsule (6) in place on the container characterised in that the shaker additionally comprises
(f) retractable gripping means (67) for gripping the container,
(g) holding means (4) for holding the capsule against the container without compressing it sufficiently to expel additive and
(h) means (4*c*) for actuating the agitating means when the container is gripped and the capsule is held.

12. A shaker according to claim 11 wherein the holding means (4) comprises the clamping member and the shaker is provided with means (69) for interrupting the downwards movement of the clamping member at a point at which the clamping member abuts the capsule (60) without compressing it to expel additive.

13. A shaker according to claim 12 wherein the means for interrupting the downwards movement of the clamping member comprises a retractable stop (69).

14. A shaker according to claim 11 wherein the gripping means comprises retractable callipers (67).

15. A shaker according to claim 14 wherein an upper surface (69) of the callipers serves as a retractable stop for the clamping member (4).

16. A shaker according to claim 12 wherein the means for actuating the agitating means comprises a pressure sensing switch (4*c*) positioned so as to be closeable by abutment against the means (69) for interrupting the downwards movement of the clamping member (4).

* * * * *